US006343646B1

(12) United States Patent
Martins

(10) Patent No.: US 6,343,646 B1
(45) Date of Patent: Feb. 5, 2002

(54) HEAT EXCHANGER WITH FLEXIBLE TUBES ESPECIALLY FOR A MOTOR VEHICLE

(75) Inventor: Carlos Martins, Montfort L'Amaury (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/558,734

(22) Filed: Apr. 26, 2000

(30) Foreign Application Priority Data

Apr. 29, 1999 (FR) ..... 99 05463

(51) Int. Cl.[7] ..... F28D 1/047

(52) U.S. Cl. ..... 165/151; 165/173; 165/162; 165/905; 165/906; 165/124

(58) Field of Search ..... 165/151, 158, 165/906, 124, 173, 162

(56) References Cited

U.S. PATENT DOCUMENTS

| | | | | | |
|---|---|---|---|---|---|
| 1,260,352 | A | * | 3/1918 | Eligh | 165/151 |
| 1,531,199 | A | * | 3/1925 | Lehman et al. | 165/151 |
| 2,261,579 | A | * | 11/1941 | Booth | 165/41 |
| 2,312,767 | A | * | 3/1943 | Meyerhoefer | 165/124 |
| 3,718,181 | A | * | 2/1973 | Reilly et al. | 165/180 |
| 3,841,938 | A | * | 10/1974 | Grosse-Holling et al. | 156/296 |
| 5,960,864 | A | * | 10/1999 | Morita | 165/82 |

FOREIGN PATENT DOCUMENTS

| | | | |
|---|---|---|---|
| EP | 0 181 614 | 5/1986 | |
| EP | 0 641 155 | 3/1995 | |
| FR | 515625 B1 * | 4/1921 | 165/76 |
| FR | 2 542 438 | 9/1984 | |
| WO | 81/00297 | 2/1981 | |

OTHER PUBLICATIONS

Patent Abstracts of Japan vol. 010, No. 138 (M–480), May 21 1986 & JP 60 259898 A (Nihon Barukaa Kogyo KK) Dec. 21, 1985.
French Search Report dated Dec. 3, 1999.

* cited by examiner

*Primary Examiner*—Allen Flanigan
(74) *Attorney, Agent, or Firm*—Morgan & Finnegan LLP

(57) ABSTRACT

A motor vehicle heat exchanger has a bundle (10) formed solely from flexible tubes (12) made of plastics, as well as two end blocks (22, 24) joining these tubes. The heat exchanger further has at least one spacer (50) arranged at a chosen location between the end blocks (22, 24) and including apertures for the tubes to pass in order to provide support for the tubes (12) with a chosen spacing or pitch.

8 Claims, 3 Drawing Sheets

HEAT EXCHANGER WITH FLEXIBLE TUBES ESPECIALLY FOR A MOTOR VEHICLE

FIELD OF THE INVENTION

The invention relates to heat exchangers, for a motor vehicle in particular.

It relates more particularly to a heat exchanger of the type comprising a bundle formed solely from flexible tubes made of plastics, as well as two end blocks joining these tubes.

BACKGROUND OF THE INVENTION

Heat exchangers of this type are already known; they are also called "finless exchangers" given that the bundle is formed solely from flexible tubes, also called capillary tubes. These may be of small diameter, typically of the order of 1 or 2 millimeters, and are usually produced by extrusion of a thermoplastic material, for example a polyamide.

Such heat exchangers can be used in the automobile industry, for example, to constitute a radiator for cooling the engine, a radiator for heating the passenger compartment, a cooler for the supercharger air or even a condenser of an air-conditioning circuit.

The advantage of these flexible tubes is that they make it possible to produce heat exchangers the tube bundle of which may exhibit particular shapes, including curved or arched shapes, so as to be able to be housed in an appropriate site in the motor vehicle. Moreover, they have the advantage of being lighter than the conventional heat exchangers with metal tubes, and they are moreover more resistant to impacts, because of their capability for deformation.

However, the production of such flexible-tube heat exchangers poses certain problems, given that it is not always possible to apply the usual techniques used in the manufacture of traditional heat exchangers with metal fins and tubes.

In the known heat exchangers with flexible tubes, the end blocks each comprise a manifold in the form of a plate provided with apertures individually accommodating the tubes of the bundle. This solution requires intricate assembly operations having regard to the fineness of the tubes and the large numbers of them.

Another problem relating to these known heat exchangers is due to the flexibility of the tubes. In fact, they have a tendency to move closer to one another thus forming an obstacle to the passage of the airflow that should sweep over the bundle. It is therefore necessary to provide means for holding the tubes spaced apart. The design of such spacer means poses numerous problems having regard to the fineness of the tubes and to the high number of them.

Another problem posed by these known heat exchangers lies in the supporting of the tubes which not only are flexible, but may also be of non-linear shapes.

The object of the invention is at least to partially mitigate the abovementioned drawbacks.

SUMMARY OF THE INVENTION

According to the present invention there is provided a heat exchanger, for a motor vehicle in particular, comprising a bundle formed solely from flexible tubes made of plastics, as well as two end blocks joining these tubes, characterized in that it comprises at least one spacer arranged at a chosen location between the end blocks and including apertures for the tubes to pass in order to provide support for the tubes with a chosen spacing or pitch.

It results therefrom that the tubes of the bundle are held spaced apart from one another, in such a way that the bundle can be correctly swept by a flow of air.

In one embodiment of the invention, each spacer is produced in the form of a generally flat plate provided with a plurality of individual holes spaced apart from one another and each suitable for being traversed by one tube of the tube bundle.

In another embodiment, each spacer is produced in the form of a generally flat plate provided with a plurality of oblong apertures spaced apart from one another and each suitable for being traversed by an aligned series of tubes of the bundle.

In this latter embodiment, the exchanger advantageously comprises at least one first spacer having first oblong apertures each suitable for being traversed by a row of tubes and at least one second spacer having second oblong apertures each suitable for being traversed by a column of tubes, the first oblong apertures and the second oblong apertures extending in orthogonal directions.

This second embodiment allows easier assembly than the preceding one, given that the tubes are introduced in aligned series and not individually.

According to another characteristic of the invention, each spacer is fixed between two crosspieces (also called cheeks) framing the tube bundle. These crosspieces contribute to supporting the bundle and to the rigidity of the assembly.

Advantageously, each spacer and the crosspieces are formed from a plastics material, particularly a thermoplastic material such as a polyamide.

Each spacer can be fixed to the crosspieces either by mechanical means, in particular by clipping, or else by bonding or by welding.

According to yet another characteristic of the invention, each spacer is placed in an orientation chosen in order to channel a flow of air sweeping the bundle of tubes.

BRIEF DESCRIPTION OF THE DRAWINGS

In the description which follows, given solely by way of example, reference will be made to the attached drawings, in which.

DESCRIPTION OF THE PREFERRED EMBODIMENTS

Figures 1, 2:
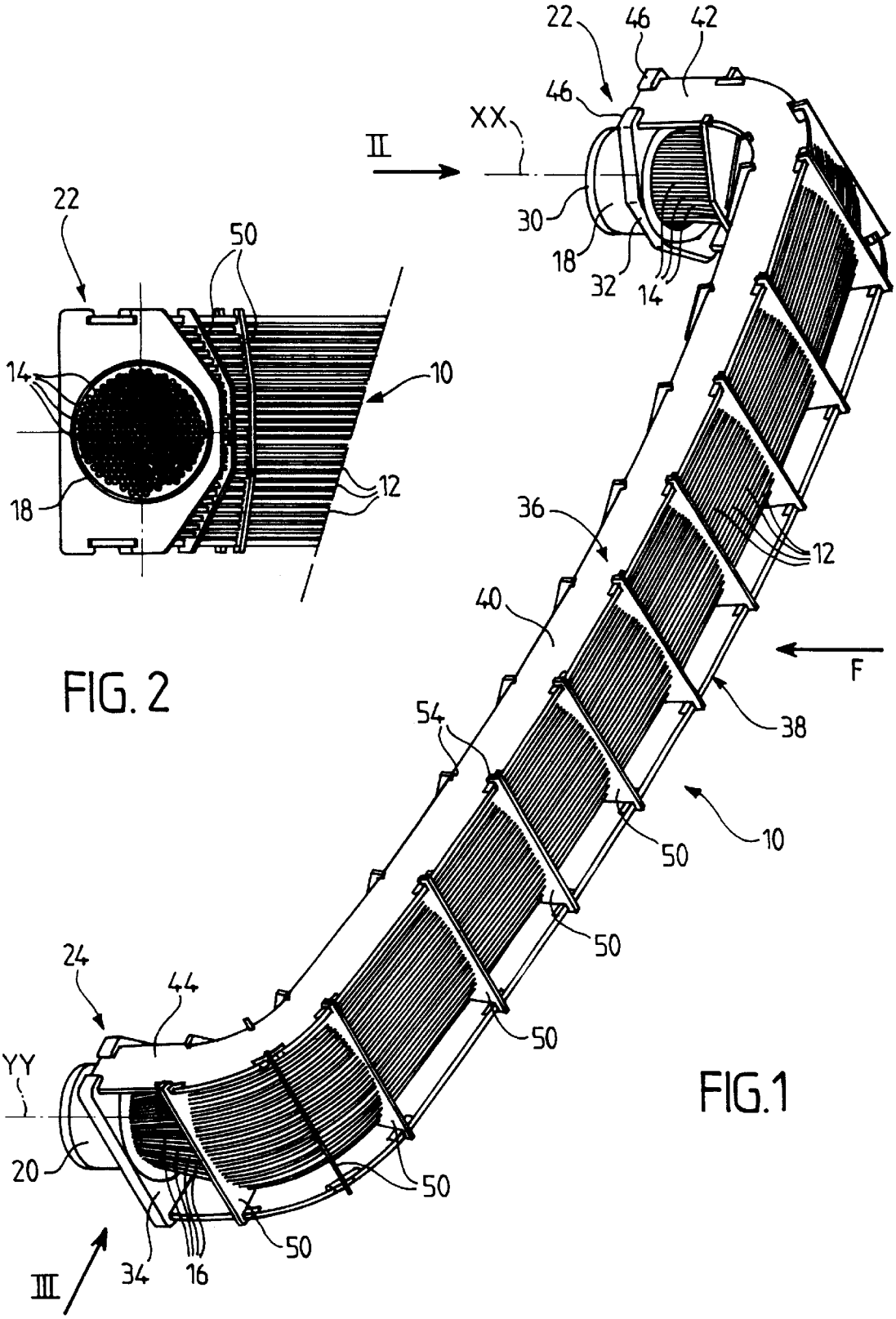
FIG. 1 is a perspective view of a heat exchanger with flexible tubes according to a first embodiment of the invention.
FIG. 2 is a partial plan view taken in the direction of the arrow II of FIG. 1.

In the various figures, like reference numerals refer to like parts.

Referring first of all to FIG. 1, a heat exchanger is represented which, in this example, is suitable for constituting a cooler of the supercharging air for a motor-vehicle engine.

This exchanger comprises a bundle 10 formed solely from flexible tubes 12, also called capillary tubes, the diameter of which is generally of the order of a millimeter. These tubes are produced by extrusion of a thermoplastic material, in particular a polyamide. As can be seen in FIG. 1, these tubes are not linear, but in contrast have a particular arched shape which, in this example, makes it possible to incorporate the heat exchanger into a housing defined behind the front bumper (not represented) of the vehicle.

The tubes 12 have respective extremities 14 and 16 configured in such a way that the extremities 14 are grouped together against one another so as to form a packet inserted into a pipe 18. In a corresponding way, the extremities 16 of the tubes are grouped together against one another so as to form a packet which is inserted into another pipe 20.

Figure 3:
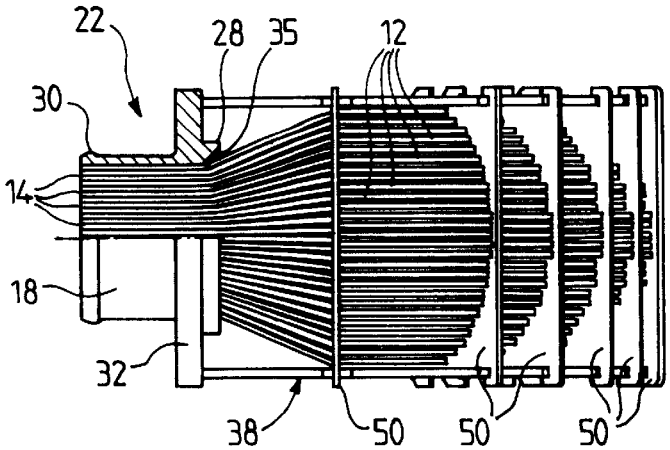
FIG. 3 is a plan view, in the direction of the arrow III of FIG. 1, with partial cutaway.

These pipes 18 and 20 form part respectively of two end blocks 22 and 24. The structure of the end block 22 will now be described more particularly, with reference to FIGS. 2 and 3. The pipe 18, in this example, takes up a generally circular cylindrical shape delimiting an internal passage 26 of generally circular cylindrical shape into which the extremities 14 of the tubes are pushed. In the coursing part of the bundle, lying between the extremities 14 and 16, the tubes are spaced apart from one another by means which will be described later.

In contrast, in the pipes 18 and 20, the extremities of the tubes are grouped together to form a packet which is inserted into the pipe.

The pipe 18 includes a conical entry 28 (FIG. 3) to facilitate the insertion of the extremities of the tubes, which have previously been grouped together into a packet. At its other end, the pipe includes an external retaining bead 30 (FIGS. 2 and 3) which may serve for connecting to a flexible hose or duct (not represented) held by an appropriate collar.

Each of the pipes 18 and 20 is produced by molding from plastics, advantageously a thermoplastic material such as a polyamide. In this example, each of these pipes is molded integrally with a support plate 32, 34 respectively, which extends in a direction generally perpendicular to the respective axes XX and YY of the pipes 18 and 20. In order to hold the tubes and preserve leaktightness between the tubes and the inside of the corresponding pipe, an adhesive 35 is applied, some of which can be perceived in FIG. 3, in the annular area lying between the conical entry 28 and the tubes of the bundle.

This adhesive, which is of the silicone type, for example, can be applied in different ways. One of the solutions which can be envisaged is to inject it, after insertion of the extremities of the tubes into the corresponding pipe. Another solution consists in depositing the adhesive in advance around the tubes, before engaging the extremities of the tubes into the corresponding pipes.

As can be seen in FIG. 1, the end blocks 22 and 24 are fixed between two crosspieces 36 and 38, also called "cheeks" or "flanks". These crosspieces frame the bundle 10. They are produced in the form of two generally flat plates extending parallel to each other. In this example, these plates have a particular shape which makes it possible to shape the bundle 10 to the desired form. These crosspieces 36 and 38 are advantageously produced by molding from a plastics material, in particular a polyamide.

The crosspieces 36 and 38 are of matched shapes. Thus, the crosspiece 36 includes a central web 14 of arched shape connected to two end parts 42 and 44 which are substantially parallel to each other and which serve as a support respectively for the end blocks 22 and 24, in such a way as to give these blocks a chosen orientation. In this example, the respective axes XX and YY of the pipes 18 and 20 are substantially parallel.

As can be seen in FIG. 1, the support plate 32 of the end block 22 includes two opposite lugs 46 taking the form of hooks turned towards one another, which allow mechanical fixing of the support plate 32 onto the end 42 of the crosspiece 36. This support plate is fixed by similar means to the crosspiece 38. The same goes for the support plate 34 of the end block 24.

Furthermore, the heat exchanger comprises a plurality of spacers 50 each arranged at chosen locations between the end blocks 22 and 24. Each spacer 50 is produced in the form of a plate which extends perpendicularly between the crosspieces 36 and 38 and which is fixed to them by appropriate means. Furthermore, these spacers are each traversed by the tubes 12 of the bundle 10.

Figure 4:
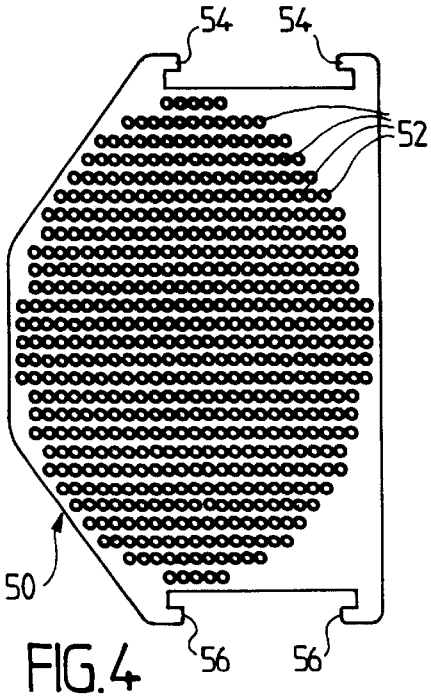
FIG. 4 is a plan view of a spacer in one embodiment of the invention.

In the embodiment of FIG. 4, the spacer 50 includes individual apertures 52 for the tubes of the bundle to pass through. These apertures, of circular shape, correspond in number to that of the tubes of the bundle (several hundreds in the example represented). These apertures 52 are aligned in columns and in rows and they define, by their envelope, a generally elliptical or oval overall shape. In this embodiment, it is therefore necessary to thread each of the tubes 12 into the respective holes 52 of each of the spacers 50, the latter then being placed at appropriate locations between the crosspieces 36 and 38.

In this example, each of the spacers 50 includes, on one side, a pair of lugs 54 in the form of opposed teeth and, on the other side, another pair of lugs 56, also in the form of opposed teeth. These pairs of lugs allow mechanical fixing of the spacers 50 between the crosspieces 36 and 38 by clipping or the like.

Figure 5:
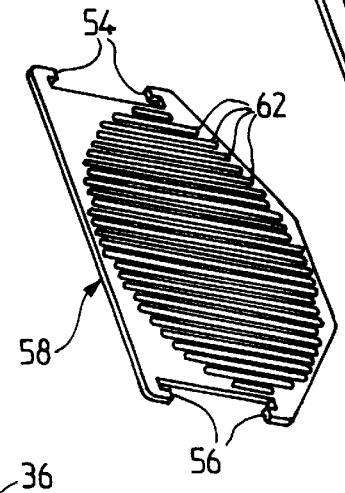
FIGS. 5 and 6 are perspective views of two spacers in another embodiment of the invention.
Figure 6:
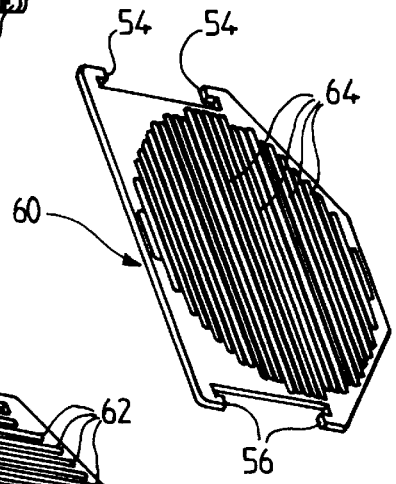

In the embodiment of FIGS. 5 and 6, at least one first spacer 58 and one second spacer 60 are used, having substantially the same shape. The spacer 58 has oblong apertures 62 each suitable for being traversed by an aligned series of tubes of the bundle, in this example a row of tubes. In contrast, the second spacer 60 has oblong apertures 64 each suitable for being traversed by an aligned series of tubes, in this example a column of tubes.

As can be seen in FIGS. 5 and 6, the oblong apertures 62 and the oblong apertures 64 extend in orthogonal directions. The embodiment of FIGS. 5 and 6 facilitates the fitting of the tubes, given that they can be inserted in aligned series (rows or columns) through the spacers 58 and 60, instead of being inserted individually into apertures 52 in the case of the spacer 50.

The spacers 58 and 60 are fixed to the crosspieces 36 and 38 by lugs 54 and 56 similar to those of the spacer 50 described above.

In a variant, the spacers 50, 58 and 60 can be fixed to the crosspieces by other means, in particular by bonding or by welding.

As can be seen in FIG. 1, the spacers 50 are not only placed at chosen locations, but also with chosen orientations, which makes it possible to channel a flow of air F passing through the bundle.

Figure 7:
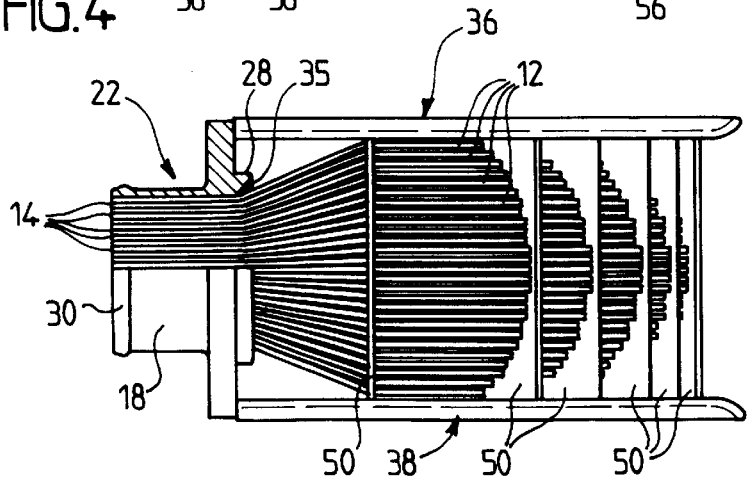
FIG. 7 is a view similar to FIG. 3 in a second embodiment of the invention.

It is also advantageous, for channeling the flow of air, to give the crosspieces 36 and 38 a particular shape. Hence, as can be seen more particularly in FIG. 7, these crosspieces have profiles shaped to promote the guidance of the flow of air F. In particular, the crosspieces 36 and 38 have respective leading edges 66 and 68 of rounded shape turned to face into the air flow. This facilitates the guiding of the air flow F which can then appropriately sweep over the tubes of the bundle, which are held with a regular spacing by virtue of the spacers 50 or else 58 and 60.

Figure 8:
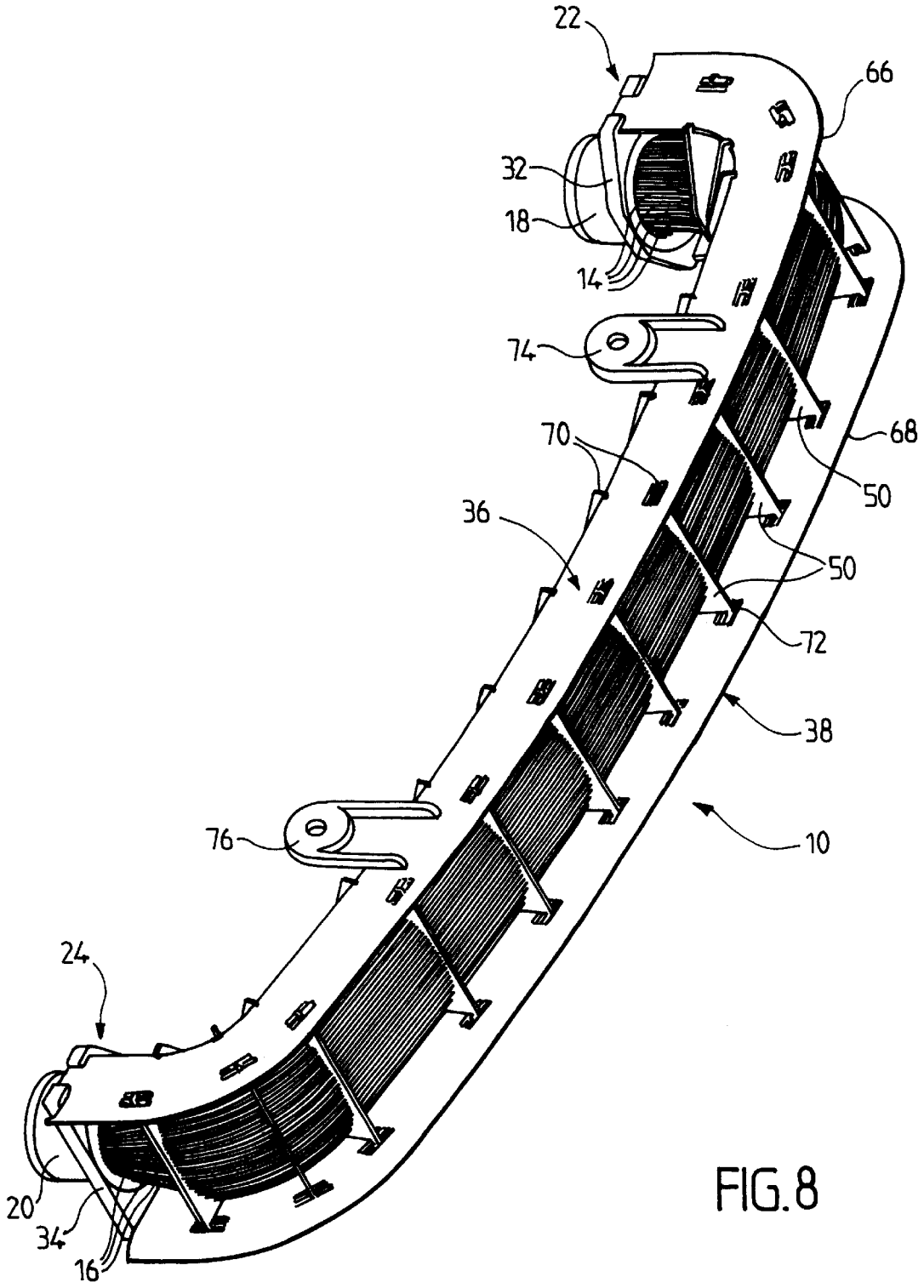
FIG. 8 is a perspective view of a heat exchanger according to this second embodiment.

In the embodiment of FIG. 8, a general structure similar to that of FIG. 1 is again found.

The principal differences lie in the way in which the spacers 50 are fixed to the crosspieces 36 and 38. In this example, these spacers have lugs 70 for clipping with the crosspiece 36 and lugs 72 for clipping with the crosspiece 38.

Moreover, the crosspiece 36 includes two fixing lugs 74 and 76 molded integrally with it. These lugs are intended either for fixing the crosspiece onto the structure of the vehicle, or for fixing accessories onto the heat exchanger. The other crosspiece 38 may include at least one similar fixing lug, as the case may be.

Obviously, the invention is not limited to the embodiments described above by way of example and extends to other variants.

It will be understood that the heat exchanger can be produced according to a multitude of possible configurations.

I claim:

1. A heat exchanger, for a motor vehicle, comprising a bundle formed solely from flexible tubes made of plastics, as well as two end blocks joining these tubes, characterized in that the heat exchanger comprises at least one spacer arranged at a chosen location between the end blocks, said at least one spacer comprising a generally flat plate and including a plurality of oblong, spaced apart, apertures for the tubes to pass through in order to provide support for the tubes with a chosen spacing or pitch, each such at least one spacer being suitable for being traversed by an aligned series of tubes of the bundle.

2. The heat exchanger of claim 1, wherein each spacer is produced in the form of a generally flat plate provided with a plurality of individual holes spaced apart from one another and each suitable for being traversed by one tube of the bundle.

3. The heat exchanger of claim 1, further comprising at least one said first spacer having first oblong apertures, each suitable for being traversed by a row of tubes, and at least one second spacer having second oblong apertures, each suitable for being traversed by a column of tubes, and in that the first oblong apertures and the second oblong apertures extend in orthogonal directions.

4. The heat exchanger of claim 1, wherein each spacer is fixed between two crosspieces framing the bundle.

5. The heat exchanger of claim 4, wherein each spacer and the crosspieces are formed from a thermoplastic material.

6. The heat exchanger of claim 4, wherein each spacer is fixed to the crosspieces by mechanical means.

7. The heat exchanger of claim 4, wherein each spacer is fixed to the crosspieces by bonding or by welding.

8. The heat exchanger of claim 1, wherein each spacer is placed in an orientation chosen in order to channel a flow of air sweeping the bundle.

* * * * *

UNITED STATES PATENT AND TRADEMARK OFFICE

CERTIFICATE OF CORRECTION

PATENT NO. : 6,343,646 B1
DATED : February 5, 2002
INVENTOR(S) : Martins

It is certified that error appears in the above-identified patent and that said Letters Patent is hereby corrected as shown below:

Title page,
Delete the statement "8 Claims, 3 Drawing Sheets" and substitute therefor -- 10 Claims, 3 Drawing Sheets. --

Column 6,
Line 1, between the words "apart" and "apertures" insert the words --, closed ended --.
Please add the following claims 10 and 11 as follows:

10. -- The heat exchanger of Claim 6, wherein said thermoplastic material is a polyamide.

11. The heat exchanger of Claim 7, wherein said mechanical means is accomplished by clipping. --

Signed and Sealed this

First Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,343,646 B1
DATED : February 5, 2002
INVENTOR(S) : Martins

It is certified that error appears in the above-identified patent and that said Letters Patent is hereby corrected as shown below:

Title page,
Delete the statement "8 Claims, 3 Drawing Sheets" and substitute therefor -- 10 Claims, 3 Drawing Sheets. --

Column 6,
Line 1, between the words "apart" and "apertures" insert the words -- , closed ended --.
Please add the following claims 9 and 10 as follows:

9. -- The heat exchanger of Claim 6, wherein said thermoplastic material is a polyamide.

10. The heat exchanger of Claim 7, wherein said mechanical means is accomplished by clipping. --

This certificate supersedes Certificate of Correction issued October 1, 2002.

Signed and Sealed this

Twenty-seventh Day of May, 2003

JAMES E. ROGAN
*Director of the United States Patent and Trademark Office*